United States Patent [19]

Reed

[11] 4,218,994

[45] Aug. 26, 1980

[54] FLUID INTAKE AND EXHAUST ASSEMBLIES FOR POSITIVE DISPLACEMENT APPARATUS

[76] Inventor: Ewell R. Reed, 1551 Oak Knoll, Dallas, Tex. 75208

[21] Appl. No.: 969,339

[22] Filed: Dec. 14, 1978

[51] Int. Cl.[2] ..... F01L 11/00

[52] U.S. Cl. ..... 123/47 R; 123/47 AA; 123/52 A; 123/90.1; 123/188 B; 123/188 R; 123/65 R; 123/65 A; 123/65 VA; 123/65 VB; 123/65 V

[58] Field of Search ..... 123/47 AA, 47 R, 52 A, 123/90.1, 188 B, 65 V, 65 VA, 188 C, 188 R, 65 A, 65 VB, 65 R

[56] References Cited

U.S. PATENT DOCUMENTS

| | | | |
|---|---|---|---|
| 592,669 | 10/1897 | Sintz | 123/65 VB |
| 864,086 | 8/1907 | Drechsler | 123/65 VB |
| 1,082,341 | 12/1913 | Kerner | 123/65 VB |
| 1,148,206 | 7/1915 | Westinghouse | 123/65 VB |
| 1,458,771 | 6/1923 | Pagel | 123/65 VB |
| 1,515,529 | 11/1924 | Well | 123/65 VB |
| 1,518,982 | 12/1974 | Hyvernaud | 123/65 VB |
| 2,224,229 | 12/1940 | Miller | 123/65 VB |

*Primary Examiner*—Wendell E. Burns
*Attorney, Agent, or Firm*—Kenneth R. Glaser

[57] ABSTRACT

Disclosed are intake and exhaust assemblies for forced air intake, reciprocating piston, internal combustion engine. Alternate embodiments of the air intake valve assembly include a hollow tube defining the intake port with means operatively coupling the tube and piston to respectively open and close the intake port in response to the reciprocation of the piston. The exhaust valve assembly includes operatively interrelated valve stem, spring retainer, rocker arm, and camming assemblies for alternatingly opening and closing the exhaust port for predetermined time intervals.

8 Claims, 4 Drawing Figures

FLUID INTAKE AND EXHAUST ASSEMBLIES FOR POSITIVE DISPLACEMENT APPARATUS

This invention pertains to positive displacement apparatus, and more particularly to internal combustion engines, and even more particularly to air intake and exhaust assemblies for two-stroke cycle engines.

Developments are continuing to date to produce improved and more efficient internal combustion engines, particularly of the reciprocating piston type, in order to maximize the efficient utilization of fuel while at the same time minimizing the cost of production of the engines and the pollution produced thereby. In this regard, there are numerous advantages which can be realized by the use of two cycle engines for the production of the required motive power. As a consequence, research and development have been directed to improve the operating efficiency of these two cycle engines, particularly in the area of the intake and exhaust valve assemblies. For example, in the prior art patents to Adams Ser. No. 877,818; Crimmins U.S. Pat. No. 1,786,106; Colter U.S. Pat. No. 1,787,856; Reilly U.S. Pat. No. 3,301,234; Von Steggern U.S. Pat. No. 3,363,611; Buchi U.S. Pat. No. 2,924,069; and Buchi U.S. Pat. No. 2,962,009, various types of interconnected intake and exhaust valve/piston assemblies are disclosed for use in two cycle engines. While such apparatus and assemblies are generally suited for their intended purposes, they are not entirely acceptable for all conditions of service and include structural and operating deficiencies which, as subsequently described, have been overcome by the apparatus of the present invention.

It is therefore a principal object of the present invention to provide new and improved positive displacement apparatus, particularly of the reciprocating piston internal combustion engine type.

It is another object of the invention to provide a new and improved two-stroke cycle internal combustion engine which is more efficient in terms of both construction and operation, and which provides more complete combustion, enhanced scavanging of combustion products, and improved cooling after combustion.

It is an even further object of the present invention to provide a new and improved design for both the air intake and exhaust valve assemblies of a two-cycle internal combustion engine.

In accordance with these and other objects, the present invention is directed to a forced air intake, reciprocating piston, internal combustion engine comprising alternate embodiments of an elongated, hollow air intake valve assembly operatively coupled with the reciprocating piston to alternately open and close off the intake port to the piston chamber. In addition, a uniquely designed exhaust valve assembly, operatively coupled with rocker arm and camming subassemblies, alternately open and close off the exhaust port from the piston chamber during predetermined time intervals during the operation of the engine.

Specific features of the apparatus of the present invention, as well as additional objects and advantages thereof, will become readily apparent from the following detailed description, taken in conjunction with the accompanying drawings, in which.

Figure 1:
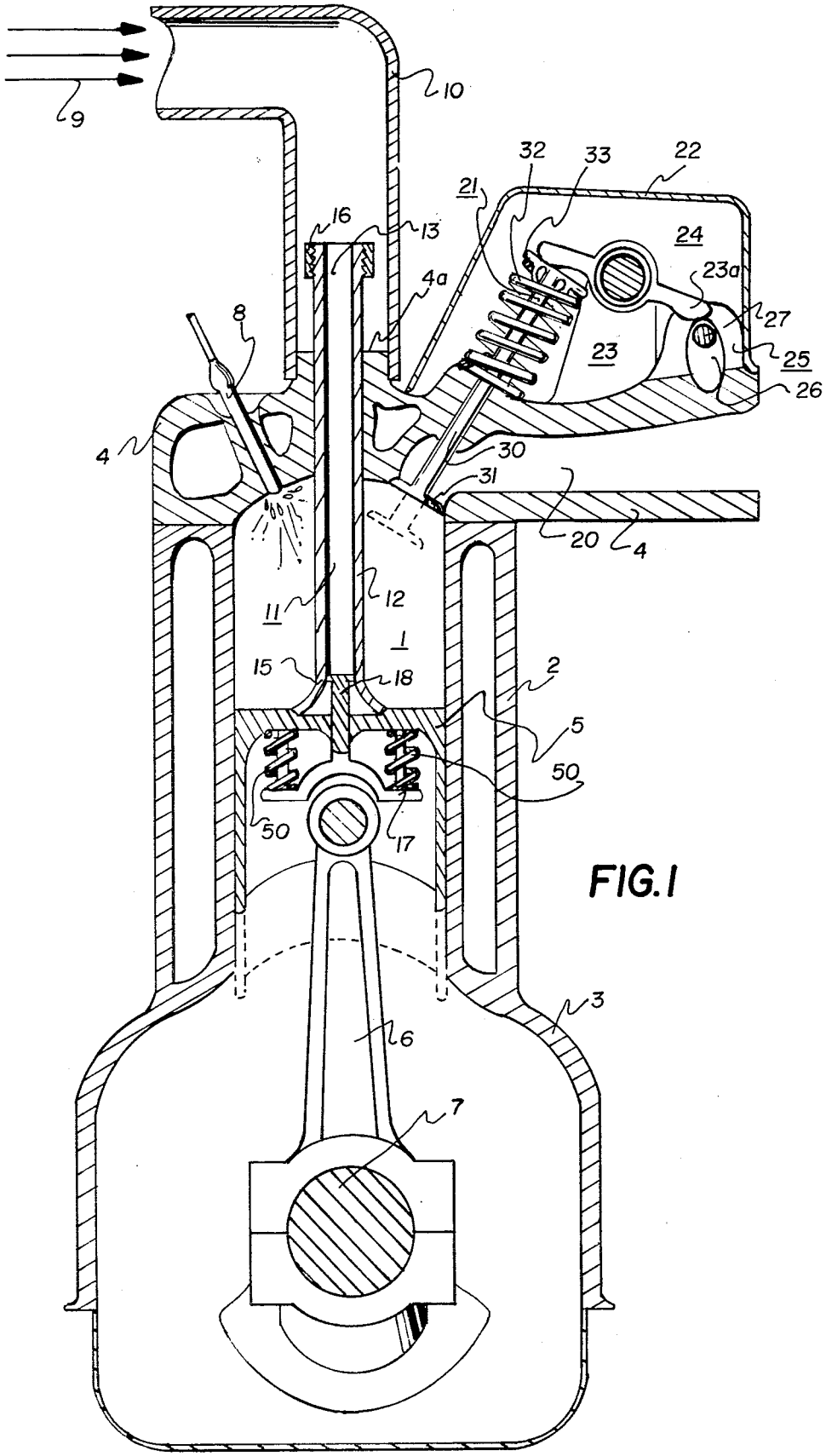
FIG. 1 is a longitudinal section of the portion of a two-stroke internal combustion engine pertinent to the present invention, illustrating the piston in its uppermost position with the intake and exhaust valve assemblies in their closed conditions.

The drawings are not necessarily to scale, and in some instances portions have been exaggerated in order to emphasize particular features of the invention.

Referring now to the drawings, the portion of an internal combustion engine pertinent to the present invention is depicted as including a main piston chamber 1 defined by the interior wall of a cylinder housing 2. The particular type of engine is not critical to the present invention and could be, for example, either of a conventional gasoline or diesel type. As is conventional, the cylinder 2 is formed as the upper portion of the engine block with a lower continguous portion 3 defining the crankcase of the engine, the engine head 4 closing off the top of the cylinder. It is to be understood that the particular engine may, if desired, include a number of cylinders, all of the type depicted in FIGS. 1 and 2, in which event the present description would similarly apply to each such cylinder.

A piston 5 is mounted in the conventional manner for reciprocating movement within the chamber 1 and is connected to the crankshaft 7 by way of connecting rod 6. In the manner well known in the art, the crankshaft is eccentrically mounted to the drive shaft for rotation within the crankcase as the piston 5 reciprocates between an uppermost position (depicted in FIG. 1) and its lowermost position (depicted in FIG. 2).

Extending through the engine head 4 is the nozzle portion of a fuel injector 8 for introducing the appropriate fuel into the piston chamber 1. The fuel injector can be any one of a variety of conventional designs which is appropriately controlled to inject the particular type of fuel at the optimum time. For example, in the case of a diesel engine, the diesel fuel would be injected at the desired point of ignition; while, in the case of a gasoline engine, the fuel injector would be effective to inject the gasoline immediately after the closing of the intake and exhaust valves (as subsequently described) in order to increase the time for uniform mixing of the air and fuel and to maximize the compression of the air/fuel mixture within the chamber 1. Furthermore, in the case of a gasoline type internal combustion engine, a spark plug (not shown) would be mounted in the engine head 4 for ignition of the fuel-air mixture.

Mounted with the engine head 4 is an air intake conduit 10 through which air (in the direction of arrows 9) is forced for injection into the cylinder chamber 1. This intake air would originate from an external source (not shown) in communication with the conduit 10, such external source being any suitable type of air blower or pump, the details and operation of which would be conventional and not material to understanding of the present invention.

In accordance with a unique feature of the present invention, air introduced into the intake conduit 10 would be injected into, or be prevented from entering the piston chamber, as a consequence of the respective opening or closing of an intake valve assembly 11, the details and operation of which are now described.

Accordingly, the intake valve assembly 11 comprises an elongated hollow tube 12 defining an axially extending intake port 13 providing fluid communication between the interior of the conduit 10 and an opening 14 at the base of the tube. The base of the tube terminates in an enlarged flared portion 15 (defining the opening 14); and an annular stop member 16 is threadably or rigidly secured at the opposed end thereof, as depicted in the drawings. The tube 12 is slidably mounted in the engine head 4 so as to enable reciprocating movement through, and in the axial direction of, the piston chamber 1, the stop 16 thus limiting the downward travel of the valve assembly 2 (as a consequence of its engagement with the engine head surface 4*a*).

Rigidly attached (for example, by threaded connection) to, but spaced from, the base of the tube 12 is a valve lifter assembly 17 which is disposed within a hollow segment of the piston 5. As illustrated in the drawings, the lifter assembly 17 is joined to the tube 12 by a stem 18 which is slideably and axially mounted through an opening in the top wall of the piston 5. A pair of springs 50 are disposed intermediate valve lifter segment 17 and the upper interior wall portion of the piston and are effective to normally bias the lifter segment (and therefore the entire tube 12) in the downward direction and, as subsequently described, to urge the flared portion 15 against a recessed valve seat 51 defined at the top surface of the piston. It is thus apparent when the tube is so biased, the opening 14 will be closed off preventing air flow through the intake port 13.

An exhaust valve assembly 21 alternately opens and closes off an exhaust port 20 provided in the engine head 4 for predetermined time intervals during the operation of the engine. Specifically, the exhaust valve assembly includes an elongated valve stem 30 having a disc 31 at one end and a spring retainer 33 at the opposite end, the stem 30 being slideably mounted within the engine head 4 and reciprocated in the manner subsequently described to alternately position the disc 31 for respectively opening and closing the exhaust port 20. A spring 32, disposed around the stem 30 and intermediate the engine head 4 and the spring retainer 33, normally biases the exhaust valve assembly to its closed position (position depicted by solid lines in FIG. 1).

Figure 2:
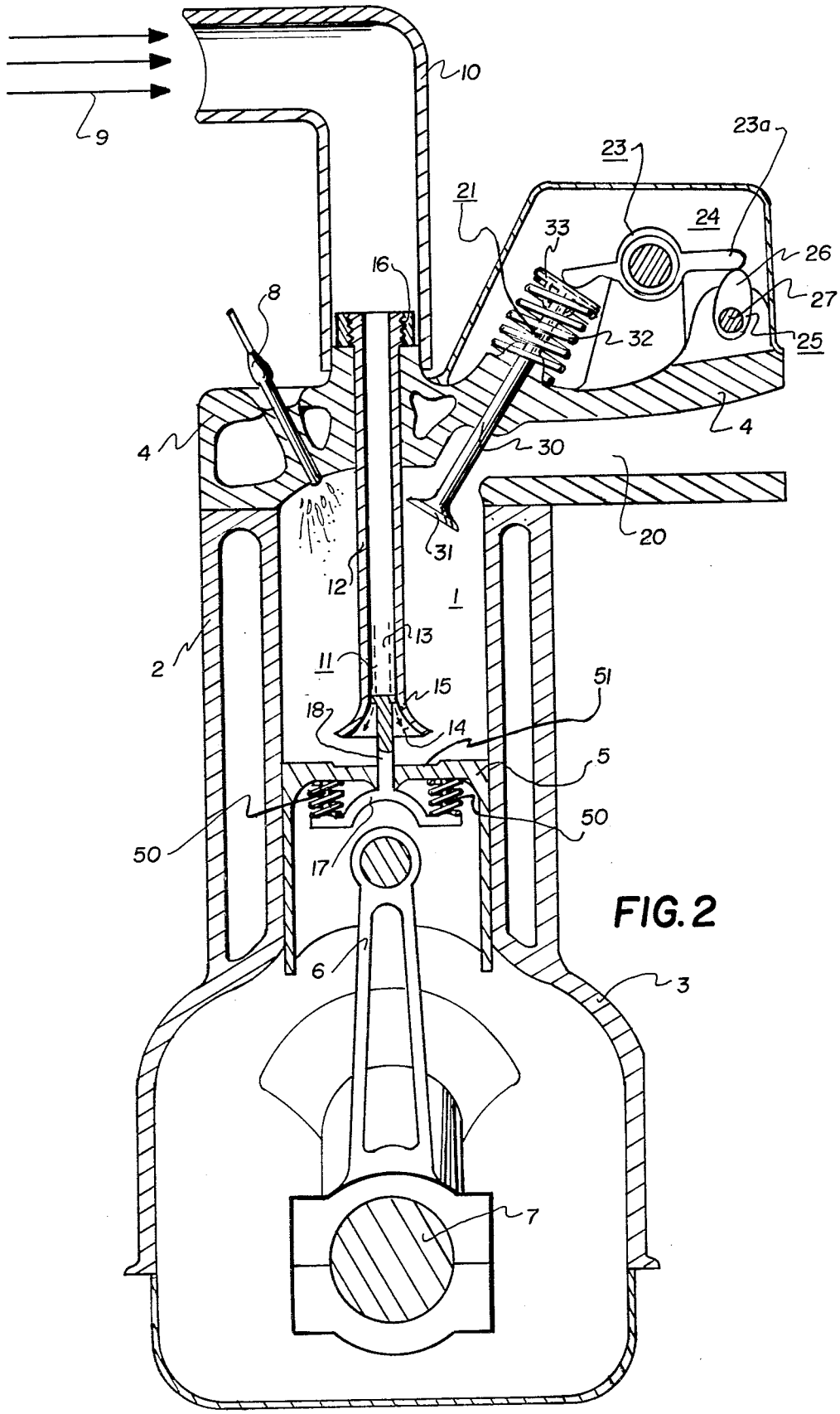
FIG. 2 is a longitudinal section substantially identical to that view depicted in FIG. 1 with the piston in its lowermost position and the intake and exhaust valve assemblies in their open conditions.

Mounted within a chamber 24 defined by a housing 22 is a rocker arm assembly 23 which, under control of a camming assembly 25, is effective to translate the stem 30 to position the exhaust valve assembly to its open position (position depicted in FIG. 2). More particularly, the camming assembly includes a cam shaft 27 which is rotated (by means not shown) to rotate cam 26 against one end 23*a* of the rocker arm, thus rotating rocker arm assembly 23 in the counterclockwise direction and consequently translating the valve stem 30 (and disc 31) to open the exhaust port 20. The continued rotation of the cam shaft then enables the rocker arm assembly to return to its original position with the spring 32 translating the exhaust valve assembly back to its closed position.

From the previous description, it is thus apparent that by controlling the operating sequence of the camming assembly, the duration of time that the exhaust port remains open (or closed) can be similarly controlled. This control feature is particularly advantageous in the case of a gasoline combustion engine where it is desirable, at high RPM, to maintain a full cylinder of air; while, at low RPM, this would not be the case. Thus, during low RPM, the rotation of the cam shaft 27 can be controlled to maintain the exhaust valve assembly in its open position for a longer period of time than during high RPM, the piston 5 forcing the excessive air out of the exhaust port 20, thus keeping the fuel-air mixture in balance while maintaining increased engine efficiency since compression of excessive air (and the consequent waste of power) would be avoided.

The operation of the assembly of the present invention is now described. Accordingly, it is initially assumed that the operating cycle of the engine is in the operating phase depicted in FIG. 1 with the piston 5 at its uppermost position and the exhaust valve assembly 21 in its closed position (thus closing off exhaust port 20). As a consequence, the chamber 1 is at maximum compression and ignition of the fuel-air mixture in the chamber would occur (spontaneously, in the case of a diesel engine and by operation of the spark plug, in the case of a gasoline engine). At such time, and as depicted in FIG. 1, the intake valve assembly 11 will be seated against the top of the piston with the air intake port 13 being consequently closed.

Upon ignition of the fuel-air mixture, the piston will be forced downward; and as a consequence of the spring biasing of the tube 12 against the top of the piston, the entire intake valve assembly 11 will initially travel with, and follow, the piston during this downward stroke. Just prior to the piston reaching its lowermost position (preferably about 30° to 40° before the completion of such cycle), the exhaust valve assembly 21 under control of the camming assembly 25, will begin to open, thus enabling the initial exhaustion of the combustion products through the exhaust port 20.

Shortly following the initial opening of the exhaust port, as just described, and as a consequence of stop member 16 engaging engine head surface 4*a*, the intake valve tube 12 will begin to separate, and be unseated, from the piston, thus resulting in the intake port 12 opening to enable the introduction of another charge of compressed air to the chamber 1. The air thus introduced into the piston chamber will force escapement of the combustion products out the exhaust port.

When the piston reaches its lowermost position (position depicted in FIG. 2), the intake valve assembly 11 is at its fully open position with the springs 50 fully compressed. The piston 5 then begins its upward stroke until it again engages the tube 12, thereby to translate the tube to lift the stop member 16 off surface 4*a*, the valve portion 15 again being reseated within the valve seat 51 to close the intake port. At approximately the same time, the exhaust valve assembly 21 will be returned (by spring 32) to its closed position, thus increasing the compression of the intake air within chamber 1. The entire assembly then returns to the original position depicted in FIG. 1 and the cycle is completed.

The fuel injector 8 would be operated, during this sequence, in accordance with the desired point of fuel injection. Specifically, in the case of a gasoline engine, the fuel would be desirably injected immediately following the time when both the intake port 13 and exhaust port 20 are closed (which, as described, occurs prior to the time that the piston reaches its uppermost position). Thus, the continued upward travel of the piston not only compresses the fuel-air mixture, but assures complete mixing thereof. In the case of the diesel engine, operation of the fuel injector would be delayed until maximum air compression within the piston chamber.

Figure 3:
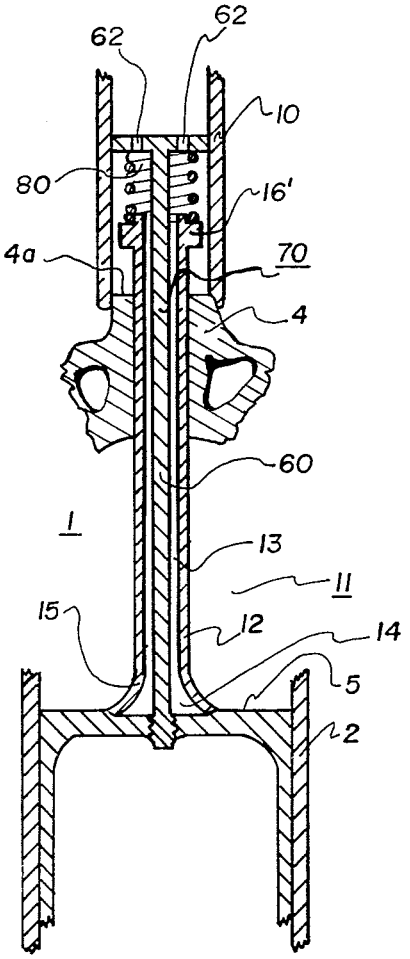
FIGS. 3 and 4 depict an alternate embodiment of the air intake valve assembly in the closed and open condition, respectively.
Figure 4:
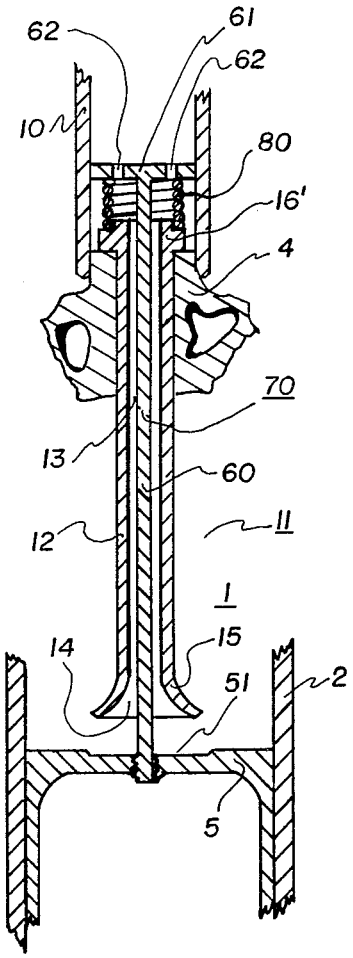

Referring now to FIGS. 3 and 4, an alternate embodiment of the intake valve assembly 11 is now described. The assembly is similar to that described with respect to FIGS. 1 and 2 in that the elongated hollow tube 12 defining the intake port 13 is slidably mounted through the engine head 4 for reciprocating movement through, and in the axial direction of, the piston chamber 1 and conduit 10; and the flared portion 15 is adapted for mating reception in the recessed piston seat 51. For convenience of illustration, the remaining portions of the housing, crankcase, etc. have been broken away in FIGS. 3 and 4, it being understood that these missing portions would be the same as depicted in FIGS. 1 and 2.

In this embodiment, however, the intake valve assembly 11 is operatively coupled with the piston 5 by way of a spring retainer assembly 70 defined by an elongated stem 60 axially extending through the intake port 13 and having one end threadably coupled with the piston 5 and the opposed end terminating in a flared head portion 61. The head portion 61 has a size and configuration adapted to slidably engage the interior wall of the conduit 10, openings 62 being provided therein so that air entering conduit 10 can flow through head 61 into intake port 13.

Disposed intermediate the head 61 and the enlarged stop member 16' is a spring 80 which is effective to urge the tube 12 downwardly toward the face of the piston 5.

In a manner similar to that previously described, when the piston 5 is at its uppermost position (FIG. 3) the valve 11 will be closed with the tube 12 (specifically flared portion 15) being retained against the piston 5 (specifically valve seat 51). As the piston travels downward, the spring 80 (and spring retainer assembly 70) will maintain the tube 12 in this seated position (and thereby maintain the intake valve assembly closed) until the stop 16' engages head surface 4*a*. Further downward travel of piston 5 will then cause the piston and tube to separate (FIG. 4) with the consequent opening of the intake valve assembly 11 and the introduction of air from conduit 10 through the port 13 and into the chamber 1.

The described preferred embodiments of the invention provide, among other advantages, a substantially more efficient, two-cycle internal combustion engine due largely to the reduction of friction which will be encountered during the power stroke as well as enhanced scavanging of the combustion products from the cylinder chamber. Furthermore, the forced intake air provides increased cooling during the exhaust cycle; and the cooling of the combustion chamber by the forced air enhances the potential for controlling nitrous oxides. The two-cycle engine of this invention, which would be of decreased weight, size and complexity, would provide, due to the uniquely designed and cooperating intake and exhaust valve assemblies, a more complete and thorough combustion within the piston chamber, thus improving the power efficiency while reducing the pollution by-products.

While the invention has been particularly described with reference to an internal combustion engine, it will be apparent to one skilled in the art that such design can be easily modified for other types of positive displacement devices, such as pumps. Various other modifications and improvements may be made by those skilled in the art without departing from the spirit and scope of the invention as defined by the appended claims.

What is claimed is:

1. In an internal combustion engine of the type including at least one cylinder chamber, a piston mounted for reciprocating movement between first and second positions within said cylinder chamber a source of forced air, and an intake valve assembly for respectively allowing and preventing the entry of said forced air into said chamber, the improvement wherein said intake valve assembly comprises an elongated hollow tube defining an intake port axially extending through said cylinder chamber and in fluid communication with said source of forced air and said chamber; and means operatively coupling said hollow tube with said piston so that when said piston reciprocates between its first and second position, the piston and tube are positioned respectively into and out of engagement with one another, thereby to alternately close off and open said intake port.

2. The improvement as defined by claim 1 wherein said piston is hollow and wherein said operatively coupling means comprises a valve lifter assembly defined by a central stem portion rigidly connected with said tube and slideably mounted through an opening in the top wall of said piston, spring means disposed within said hollow piston and intermediate the valve lifter assembly and said piston top wall, said spring means effective to normally bias said tube into engagement with said piston.

3. The improvement as defined by claim 1 wherein said operatively coupling means comprises a spring retainer assembly defined by an elongated stem axially extending through said intake port and having one end rigidly coupled with said piston and the opposed end terminating in a head portion, and spring means disposed intermediate said head portion and said tube for normally biasing said tube into engagement with said piston.

4. Positive displacement apparatus comprising:

(a) a cylinder chamber, (b) a piston mounted for reciprocating movement between first and second positions within said cylinder chamber, (c) a fluid intake conduit, (d) an intake valve assembly for respectively allowing and preventing the entry of fluid from said intake conduit into said chamber, said intake valve assembly comprising an elongated hollow tube mounted for reciprocating movement through, and in the axial direction of, said fluid intake conduit and said chamber, said hollow tube defining an intake port in fluid communication with said fluid intake conduit and said chamber; and means operatively coupling said tube with said pistons so that when said piston reciprocates between its first and second position, the piston and tube are positioned respectively in to, and out of, engagement with one another, thereby to alternately close off and open said intake port;

(e) an exhaust port communicating with said chamber; and (f) an exhaust valve assembly for alternately opening and closing off said exhaust port for predetermined time intervals during the reciprocation of said piston between said first and second positions.

5. The apparatus as defined by claim 4 wherein said piston is hollow and wherein said operatively coupling means comprises a valve lifter assembly defined by a central stem portion rigidly connected with said tube and slideably mounted through an opening in the top wall of said piston, spring means disposed within said hollow piston and intermediate the valve lifter assembly and said piston top wall, said spring means effective to normally bias said tube into engagement with said piston.

6. The apparatus as defined by claim 4 wherein said operatively coupling means comprises a spring retainer assembly defined by an elongated stem axially extending through said intake port and havine one end rigidly coupled with said piston and the opposed end terminating in a head portion, and spring means disposed intermediate said head portion and said tube for normally biasing said tube into engagement with said piston.

7. The apparatus as defined by claim 4 wherein said exhaust valve assembly comprises valve stem means reciprocated in to and out of blocking position with said exhaust port; rocker arm assembly means for reciprocating said valve stem, and camming assembly means for controlling the operating sequence of said rocker arm assembly.

8. An internal combustion engine, comprising:

(a) at least one cylinder chamber, (b) a piston mounted for reciprocating movement between first and second positions within said cylinder chamber, (c) an air intake conduit, (d) an intake valve assembly for respectively allowing and preventing the entry of air from said air intake conduit into said chamber, said intake valve assembly comprising an elongated hollow tube defining an intake port axially extending through said cylinder chamber and in fluid communication with said air intake conduit and said chamber, and (e) means operatively coupling said hollow tube with said piston so that when said piston reciprocates between its first and second position, the piston and tube are positioned respectively into and out of engagement with one another, thereby to alternately close off and open said intake port.

* * * * *